United States Patent [19]

Paradiso

[11] Patent Number: 4,932,565

[45] Date of Patent: Jun. 12, 1990

[54] CAULKING AND LIKE GUN WITH GUIDE

[76] Inventor: Thomas J. Paradiso, 6005 Main St., Davenport, Iowa 52806

[21] Appl. No.: 314,725

[22] Filed: Feb. 22, 1989

[51] Int. Cl.[5] ..... B67D 5/64

[52] U.S. Cl. ..... 222/174; 401/48; 401/193

[58] Field of Search ..... 222/173-174, 222/192, 325-327; 401/5, 9, 48, 193

[56] References Cited

U.S. PATENT DOCUMENTS

| | | | |
|---|---|---|---|
| 12,182 | 1/1855 | Hicks | 401/48 |
| 2,402,310 | 6/1946 | Beaumier | 401/193 |
| 2,549,722 | 4/1951 | Sweet et al. | 401/48 |
| 3,140,015 | 7/1964 | Sherbondy | 222/326 X |
| 3,381,861 | 5/1968 | Stein | 222/256 |
| 3,512,684 | 5/1970 | Sutton, Sr. | 222/327 |
| 3,635,378 | 1/1972 | DeHart | 222/333 |
| 3,726,440 | 4/1973 | Deeb | 222/174 |
| 3,981,595 | 9/1976 | Blake | 401/48 |
| 4,260,273 | 4/1981 | Hemperly, Jr. et al. | 401/48 |
| 4,262,822 | 4/1981 | Corte | 222/174 |
| 4,273,270 | 6/1981 | Kray | 222/327 |

FOREIGN PATENT DOCUMENTS

| | | | |
|---|---|---|---|
| 607657 | 9/1948 | United Kingdom | 401/193 |

*Primary Examiner*—Michael S. Huppert
*Attorney, Agent, or Firm*—Henderson & Sturm

[57] ABSTRACT

A caulking gun or the like for the dispensing of construction materials such as caulk, glue, sealant, etc. is provided with a guide at its front end to enable the user more easily and readily to follow an object such as a construction member, groove and other line to which the material is applied. The guide is especially useful in guns having elongated rear-end extensions that enable operation of the gun by a standing rather than a kneeling workman. The guide in one form is configured to facilitate its following a construction member such as a joist, stud, etc. The guide is also adjustable with reference to the dispensing nozzle of the gun.

1 Claim, 1 Drawing Sheet

Fig. 2
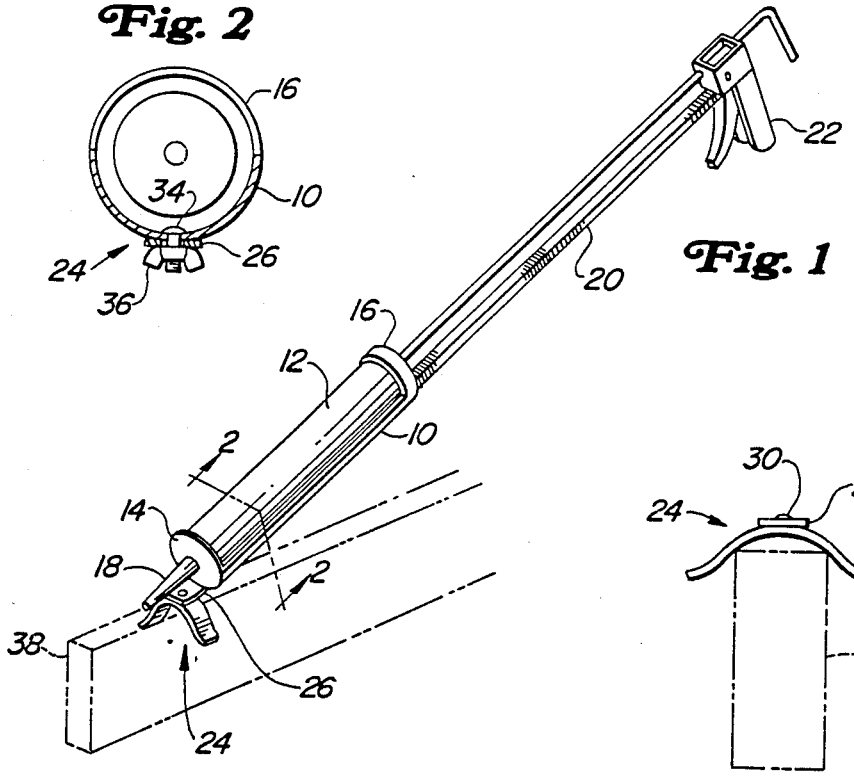
Fig. 1
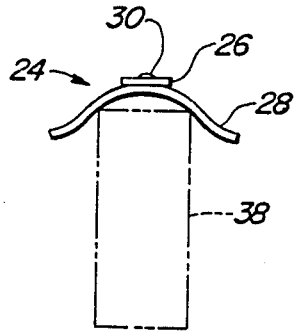
Fig. 4
Fig. 3
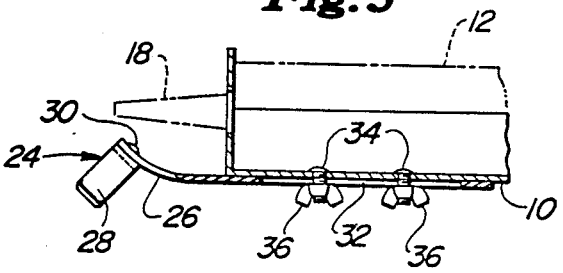
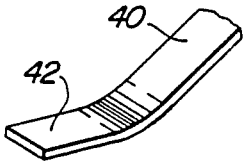
Fig. 5
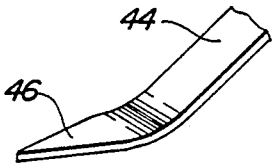
Fig. 6
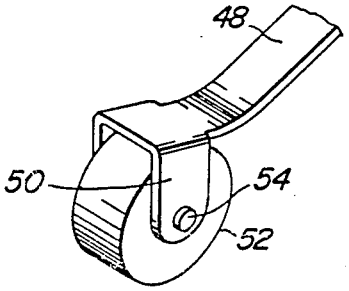
Fig. 7

CAULKING AND LIKE GUN WITH GUIDE

BACKGROUND AND SUMMARY OF THE INVENTION

It is known to provide a caulking gun or the like with an elongated extension enabling operation of the gun by a standing rather than a kneeling workman as when the apparatus is used for applying caulk and like material to a horizontal surface, as along a joist. A gun of this type also has advantages when applying material to studs or even overhead to rafters or on slopes such as roofs. Because of the distance between the workman and the dispensing nozzle of the gun, resulting from the length of the extension, it is difficult in some cases to control the application of material along a predetermined path.

According to the present invention, this problem is solved by the provision of a simple guide attached to the front end of the gun and adapted to follow a selected path along which the material is to be applied. It is a feature of the invention that the guide is adjustable relative to the dispensing nozzle so as to accommodate varying situations. By the same token, the guide may be removed from the gun for use of the gun without the guide. Another object of the invention is to provide the guide in such manner that it may be easily adapted to existing guns.

Further features of the invention will become apparent from the ensuing description and accompanying drawings.

DESCRIPTION OF THE DRAWINGS

FIG. 1 is a perspective of a gun equipped with the inventive guide, the view illustrating a construction member in dot-dash lines.

FIG. 2 is a section on the line 2—2 of FIG. 1.

FIG. 3 is a longitudinal section through a portion of the gun.

FIG. 4 is an enlarged view showing the guide in operative relation to a construction member.

FIGS. 5, 6 and 7 are partial perspectives of modified forms of guides.

DETAILED DESCRIPTION OF A PREFERRED EMBODIMENT OF THE INVENTION

In the following description as well as in the claims, the basic apparatus will be referred to as a caulking gun as a "description of art" as commonly used by workmen, suppliers, etc. It is well known that guns of this type are receivable of cartridges of many types of materials, including caulk, glue, sealant and the like. Hence, the use of the expression "caulking gun" is to be taken as descriptive and not limiting.

A typical apparatus is shown in FIG. 1 as comprising a steel body (10) of semi-circular section adapted to receive a cartridge (12) of construction compound; e.g., caulk, glue, etc. The body typically has fixed front and rear ends (14) and (16), respectively, and the front end has a central opening (not shown) through which a nozzle (18) of the cartridge extends, all as is well known in the art. Affixed to the rear of the body (10) is an elongated extension (20) having a handle (22) as means for controlling dispensing of the material via the nozzle, as by means of extension of the usual rod and plunger, not shown because they are conventional and may take many forms not inconsistent with the invention. Also, it is clear that the invention may be used with guns without the extension.

The invention guide is designated in its entirety by the numeral (24). The guide comprises an elongated member (26) positionable lengthwise of the body at the underside thereof (FIG. 3), the member forming the leg of a T-shaped element of which the crossbar is an arcuate member (28) rigidly affixed to the front end of the leg (26) as by rivets (3) or the like. The forward part of the leg is curved upwardly so as to bring the arcuate or U-shaped part (28) in closer proximity to the discharge or forward end of the nozzle (18). The leg is adjustably mounted on the underside of the body for the purpose of selectively positioning the arcuate member lengthwise (28) relative to the nozzle. Variations in position in this respect are for the purpose of facilitating use of the tool to accommodate variations of the angle of the tool relative to the surface, etc. to which the material is being applied, as by variations in the height of the user, in corners, etc. A preferred form of adjustment means comprises a lengthwise slot (32) which in the leg (26) cooperates with bolts (34) and wing nuts (36) with suitable holes (not numbered) in the underside of the body (10). The guide may be easily attached to an existing gun by drilling the body for the bolts (34).

The numeral (38) indicates a construction member, such as a joist to which, for example, glue is to be applied for the laying of plywood or like flooring. The arcuate guide part (28) easily straddles the top of the joist as the work man moves the gun along the top of the joist, thus applying the glue in a straight line. The same type of operation is applicable in other cases, as for studs, rafters, floor seams and other instances requiring the application of construction compounds along a defined path. The front portion of the leg (26) may be formed of material relatively easily bendable so as to vary the distance between it and the nozzle (18) in a direction normal to fore-and-aft adjustment, thus increasing the versatility of the guide means.

The modified guide shown in FIG. 5 is designated at (40) and is formed the same as the guide (24) as to mounting on the body (10) but it has a front part (42) which is operative as a shoe, having a flat underside to ride a surface being treated.

The further modified guide (44) of FIG. 6 has a forwardly tapered or pointed front part for use with the gun where it is necessary to follow a line rather precisely This guide is otherwise the same as the previously described guides as to mounting on the body, etc.

A further guide (48) is shown in FIG. 7 as having a rigid forward fork or yoke (50) in which a rolling element or wheel (52) is journaled via an axle (54) for rolling over a surface. Such a guide is useful where relatively high-speed application of material is involved. Again, this guide is mountable on the body as before.

Features and advantages other than those pointed out herein will be apparent to those versed in the art, along with many modifications in the preferred embodiment disclosed, all without departure from the spirit and scope of the invention.

I claim:

1. A gun of the class described for dispensing caulk, glue or the like and having an elongated body including front and rear ends and adapted to hold a cartridge of caulk, glue or the like material for dispensing at the front end of the body, an elongated rearward extension at the rear of the body and hand-held means at the rear end of the extension for controlling the dispensing and enabling a user to operate the gun from a standing position while the gun slopes downwardly and forwardly to disperse its lower end at a location relatively remote from and at a level below that of the upper, hand-held end, the improvement comprising a guide disposed ahead of the front end of the gum for guiding the front end of the gun along an elongated, rigid, relatively narrow construction element such as a joist, rafter or the like adjacent to which the user may stand, said guide having means for attachment thereof to the body, and said guide further comprising an inverted U-shaped member in the form of an arch including an upper bight and a pair of legs integral with and depending from the bight and disposed in relatively widely divergent relation to each other and respectively having terminal ends spaced apart a distance greater than the width of the construction element whereby to loosely straddle the element and to permit laterally rocking of the guide within limits to opposite sides of the element while remaining in straddling relation to the element and thereby to prevent the guide from being accidentally dislodged from the element as the standing user moves the gun along the element.

* * * * *